US005514052A

United States Patent [19]

Charles et al.

[11] Patent Number: 5,514,052

[45] Date of Patent: May 7, 1996

[54] FINGER EXERCISER

[76] Inventors: Gene Charles, 306 Eleventh St., Huntington Beach, Calif. 92648; Christian G. Ott, 8 Banyan Tree La., Irvine, Calif. 92715

[21] Appl. No.: 201,611

[22] Filed: Feb. 24, 1994

[51] Int. Cl.[6] ..... A63B 23/16

[52] U.S. Cl. ..... 482/47; 482/121; 482/124

[58] Field of Search ..... 482/44–48, 124, 482/121, 122, 128; 601/40; 602/21, 22, 32, 36, 37; 273/188 R, 189 R, 189 A

[56] References Cited

U.S. PATENT DOCUMENTS

| | | | |
|---|---|---|---|
| 248,980 | 11/1881 | Atkins . | |
| 272,951 | 2/1883 | Gardner . | |
| 327,918 | 10/1885 | Brotherhood . | |
| 494,197 | 3/1893 | Hall . | |
| 623,592 | 4/1899 | Bonney | 482/48 |
| 1,256,004 | 2/1918 | Finney . | |
| 2,108,236 | 11/1938 | Scott . | |
| 3,347,547 | 10/1967 | Hynes . | |
| 3,782,719 | 1/1974 | Kuhlman | 482/48 |
| 3,871,646 | 3/1975 | Slack | 482/48 |
| 3,944,220 | 3/1976 | Fasano . | |
| 4,455,019 | 6/1984 | Harris . | |
| 4,875,469 | 10/1989 | Brook et al. | 482/48 |

FOREIGN PATENT DOCUMENTS

| | | | |
|---|---|---|---|
| 296204 | 11/1991 | Germany | 601/40 |
| 26178 | of 1903 | United Kingdom | 482/48 |
| 2165764 | 4/1986 | United Kingdom | 482/47 |

OTHER PUBLICATIONS

PC World, May 1993, "Consumer Watch Special Report", pp. 118–124 Modern Salon, May 1993, Wrist Relief, p. 29.

*Primary Examiner*—Richard J. Apley
*Assistant Examiner*—Jeanne M. Clark
*Attorney, Agent, or Firm*—Stetina Brunda & Buyan

[57] ABSTRACT

A rehabilitative and preventative exercise device for carpal tunnel syndrome. The first embodiment includes a housing having a plurality of elastic bands extending therefrom, each elastic band being attached to a respective one of a series of screws disposed therein. By turning each screw, the tension of the attached elastic band may be either increased or decreased. The ends of each elastic band extending from the housing include a finger receiving assembly. The second embodiment includes a forearm restraint device in combination with a finger tensioning assembly. The finger tensioning assembly includes a shell having a series of tension-adjusting cleat-lock slots to which elastic members may be detachably connected. Each elastic member has a fingerlet for attachment to a finger as well as a protuberance for connecting the member to the shell. By engaging the digits of a hand in either embodiment and extending the digits outwardly, the extensor muscles of the wrist, hand, and fingers undergo a strengthening exercise.

4 Claims, 7 Drawing Sheets

52

52

FINGER EXERCISER

FIELD OF THE INVENTION

The present invention relates to exercise devices and, more particularly, to devices for strengthening or rehabilitating extensor muscles and joints in the wrist and fingers.

BACKGROUND OF THE INVENTION

A proliferation of computer keyboards in offices and homes has given rise to a dramatic increase in repetitive strain injuries such as nerve entrapments, tendon problems and muscle strain. Such injuries are commonly perceived as persistent aches in the forearms and wrists, or pain that may be felt from the shoulder to the fingertips. If left untreated, the soreness can escalate into full blown disability.

The present invention is directed a type of repetitive strain injury known as carpal tunnel syndrome. This refers to compression of the median nerve as a result of swelling of tendons and sheaths, or repeated bending of the wrist as normally occurs during extended use of computers. The position in which the hands and fingers are placed to use a keyboard typically keeps the associated muscles in flexion which may cause the carpal dome to slip in an anterior direction, causing shooting pain and numbness in the fingers. Wrist rests and other devices are commonly used to support the wrists when there is a pause during typing. However, such devices, while relieving stress on muscles and joints in some circumstances, do nothing to strengthen or rehabilitate the muscles and joints to avoid injury, or to rehabilitate from prior injury. Moreover, the advantageous aspects of wrist rests may depend on the manner in which the user's wrist is positioned. Misuse of a wrist rest may in fact cause more harm than good, increasing the potential for carpal tunnel injury.

In order to strengthen the muscles and joints of the hand to avoid carpal tunnel injury, it is desirable to strengthen the extensor muscles and joints to prevent those muscles from becoming overpowered by flexor muscles as well as becoming distrophied to the point that carpal tunnel syndrome may result. While various devices have been proposed which exercise the extensor muscles, such devices are not adequate to address the causes of carpal tunnel syndrome. In addition, prior devices which facilitate exercise of the extensor muscles in the fingers and wrists are not practical to allow convenient usage.

SUMMARY OF THE INVENTION

The present invention is directed to a finger exerciser specifically adapted for strengthening the extensor muscles of the wrist, hand, and fingers. In a first principal embodiment, a hollow, elongate housing, preferably cylindrical in shape, is provided having a plurality of apertures. At one end of the housing is positioned a cap having a hole through which is disposed a plurality of elastic cords, a portion of each cord being received within the housing as well as extending outwardly from the housing. Each elastic cord is securely fastened within the housing by an individual tension stay that is received in one of the apertures. The cords are so connected to the tension stays that, in use, the tension of each cord may be adjusted by turning the tension stays. The end portion of each cord extending outwardly from the housing further includes a finger receiving assembly that provides means for attaching the fingers for exercise purposes. Accordingly, when the fingers are received within the assembly, the hand, wrist, and fingers may be extended away from the housing and against the pull of the elastic cords thus producing an exercise effect for the extensor muscles of the hand.

In a second principal embodiment, a finger tensioning assembly is provided in association with a forearm retention strap. The forearm retention strap is flexible in nature and is shaped and designed to form a snug, annular fit about the forearm. In addition, the forearm retention strap includes a series of T-lock slots for interconnecting with the finger tensioning assembly. The finger tensioning assembly includes a shell onto which a plurality of elastic members, each member having a fingerlet and locking protuberance, are detachably mounted. The finger tensioning assembly is connected to the forearm retention strap by disposing the strap through slots formed on the shell of the finger tensioning assembly. In use, the finger tensioning assembly is placed upon the anterior portion of the forearm. Accordingly, the forearm retention strap secures the assembly into position during use. Disposed within the shell of the finger tensioning assembly are cleat-lock slots which may be used to increase or decrease the tension load of the elastic members. By attaching the elastic members onto the shell, via the connection of the locking protuberance and cleat-lock slot, an arrangement is produced whereby the elastic members extend toward the palm of the hand. While in this configuration, the fingerlets of the elastic members are placed over each respective finger and thumb. By extending the hand forward through a full range of motion for all five digits, an effective and efficient exercising experience occurs for the extensor muscles of the wrist, hands, and fingers.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps of constructing and operating the invention in connection with the illustrated embodiments. It is understood, however, that the same or equivalent functions and sequences may be accomplished by different embodiments that are also intended to be encompassed within the spirit and scope of the invention.

Figure 1:
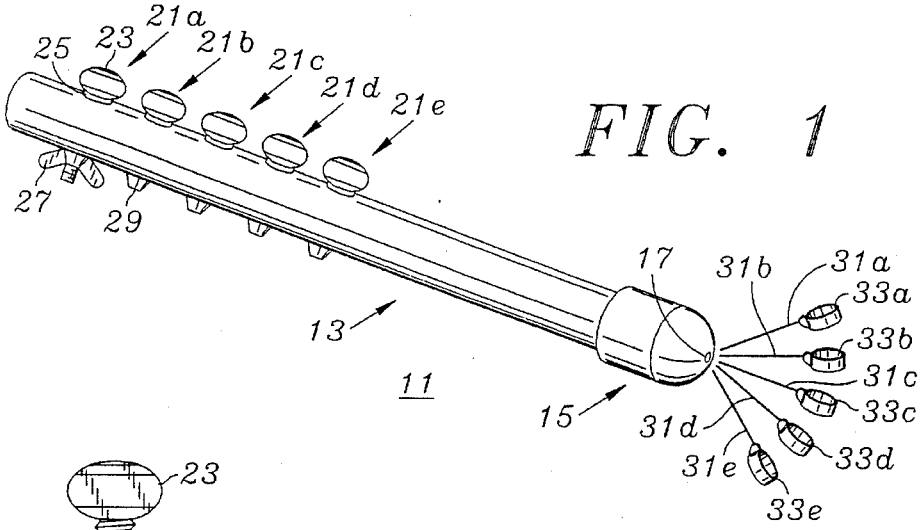
FIG. 1 is a perspective view of one embodiment of the invention.

FIG. 1 illustrates a perspective view of the carpal tunnel exerciser 11. As shown therein the carpal tunnel exerciser 11 may be formed of an elongate body 13 having a cap 15 attached at one end thereof. The cap 15 is provided with an aperture 17 through which cords 31*a*–31*e* may extend. The cords 31*a*–31*e* are each secured to a dedicated finger receiving assembly 33*a*–33*e*. At another end the cords 31*a–e* are secured through a dedicated thumb screw assembly 21*a–e*.

Figure 2:
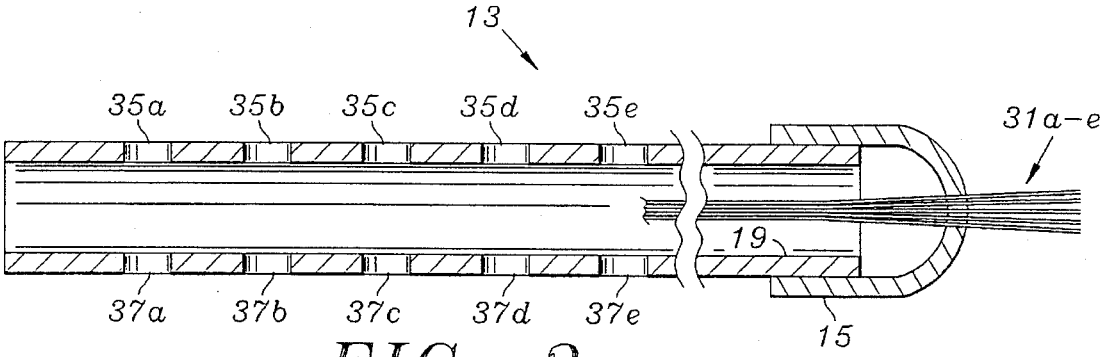
FIG. 2 is a side view of the housing shown in FIG. 1.

In the presently preferred embodiment the cords 31*a–e* are formed of elastic material selected to provide sufficient tension when extended in use. The elongated body 13 and cap 15 may be formed of metal or plastic molded material as desired. The housing 13 may be secured through the cap 15 by means of slip fitting the cap 15 over the housing forward portion 19 (FIG. 2). Alternatively, the cap 15 and housing forward portion 19 may be provided with mateable screw threads or snap fit assemblies to facilitate engagement and disengagement of the cap 15 from the housing 13.

FIG. 2 provides additional detail respecting the construction of the carpal tunnel exerciser 11. As shown therein the housing 13 is provided with a series of apertures 35*a–e*, and corresponding apertures 37*a–e*, through which the tension stay assemblies 21*a–e* extend. As shown in FIG. 1, the tension stay assemblies 21*a–e* each include a tension stay 23, a spacer 25 and a nut such as wing nut 27, or nut 29.

Figure 3:
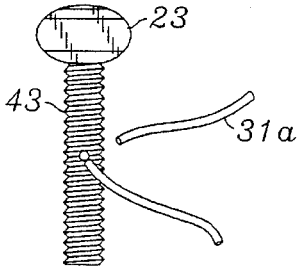
FIG. 3 is a front view of adjustment members disposed within the housing.

Referring to FIG. 3, each of the tension stays 23 are preferably provided with an aperture 43 for receiving and engaging a dedicated cord, such as cord 31*a*. Consequently, rotation of the tension stay 23 will change the tension on the cord connected to the stay, thereby varying the effort required to form the carpal tunnel exercises. As presently anticipated the tension stays 23 may be formed of metal or plastic material as desired.

Figure 4:
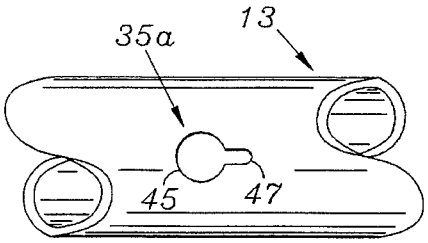
FIG. 4 is a sectional view showing keyway apertures formed in the housing.

Referring to FIG. 4, a further view of apertures 35*a–e* is provided. As shown therein aperture 35*a* is formed as a keyway having a circular portion 45 and a keyway portion 47. A circular portion 45 is sized to generally conform to the diameter of the tension stays 21*a–e*. The keyway portion 47 provides an area through which the cord attached to the tension stay may pass. This facilitates connection and disconnection of the cords to the associated tension stays. In practice the cord may be attached to the tension stay when the stay is separated from the housing 13. The cord and stay may then be inserted into the aperture 35, cord first, with the cord being allowed to drop through the housing 13. The cords may then be extended through the aperture 17, separated from the housing 13, and finally connected to the associated finger receiving assembly 33*a–e*.

Alternatively, the cords may be disconnected from the associated tension stays by withdrawing the stay from the associated aperture 35 and disconnecting the cord from the stay outside of the housing 13. In some cases it may be desirable to replace the cord 31 by connecting the new cord to the existing cord and drawing both cords through aperture 17, housing 13 and aperture 35*a*, whereupon a new cord is then connected to the associated tension stay and returned to the keyway 35.

Figure 5:
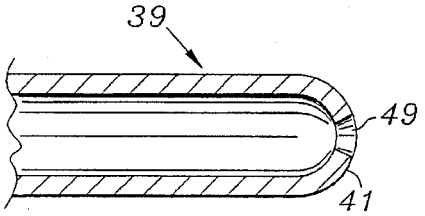
FIG. 5 is a cross-sectional view of an alternative embodiment of the housing.

Referring to FIG. 5, an alternate construction of the housing 13 is shown therein. In the embodiment shown at FIG. 5 housing 39 is provided with an integral curved end portion 41 defining an aperture 49, through which the cords 31*a–e* may extend. The embodiment shown at FIG. 5 eliminates the need for a separate cap 15, as illustrated at FIGS. 1 and 2.

Figure 6:
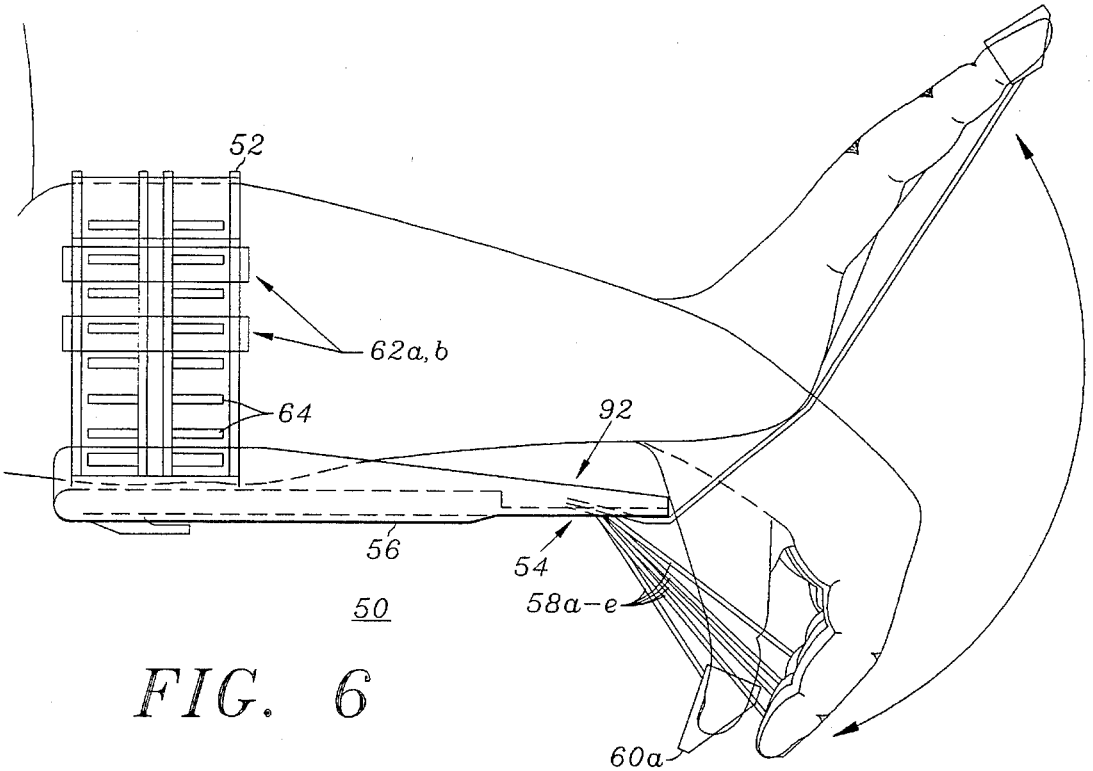
FIG. 6 is a perspective view of a finger exerciser according to a second preferred embodiment of the present invention, wherein the invention is attached to the forearm of a wearer with the device being shown in both a fully extended and fully retracted position.

Referring to FIGS. 6–20, and more particularly FIG. 6, there is shown a second embodiment of a carpal tunnel exerciser embodying the principles of the present invention. The exerciser 50 comprises a forearm retention strap 52 in combination with a finger tensioning assembly 54. The finger tensioning assembly 54 includes a shell 56, having a series of elastic members 58*a–e* that are disposed therein and attached thereto. The elastic members 58*a–e* extend outwardly via aperture 92 from the shell 56 and are specifically designed to be accessed by the fingers. At the end of each elastic member 58*a–e* extending outwardly from the shell 56 is a finger receiving assembly 60*a–e*. Each finger receiving assembly 60*a–e* is shaped and designed to be placed upon the end of a respective digit of the hand.

Figure 7:
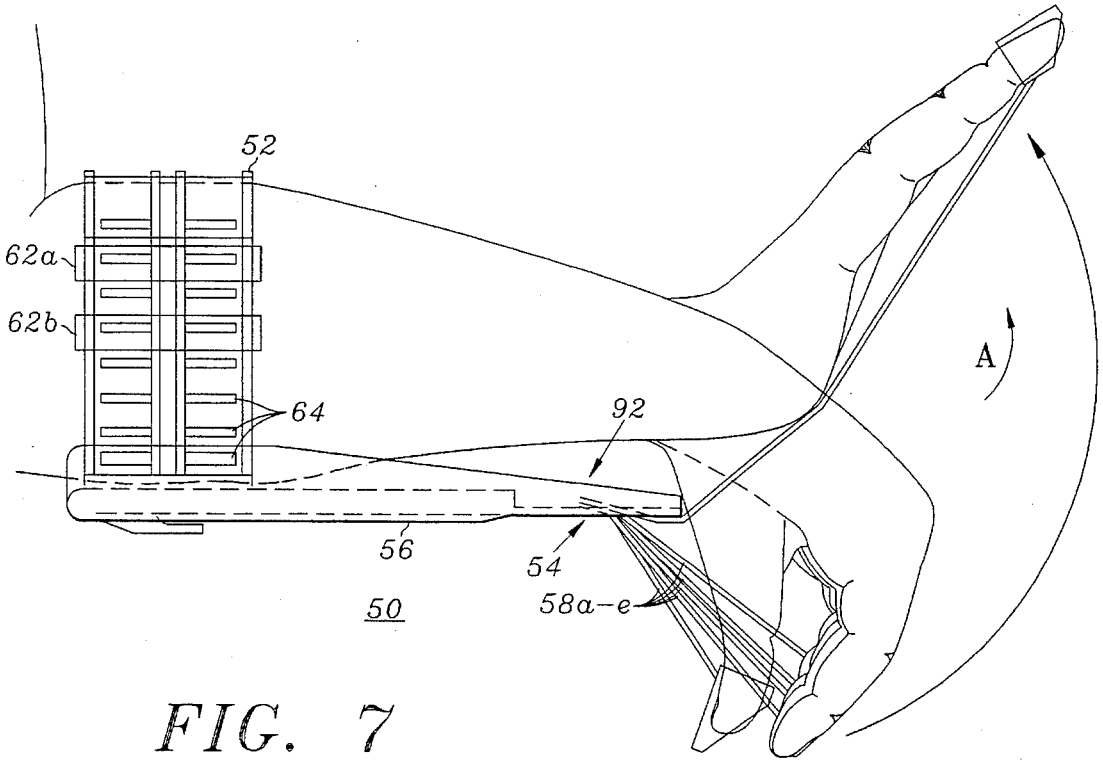
FIG. 7 is a perspective view of the finger exerciser according to the second embodiment wherein the exerciser is shown in a fully extended position and a fully retracted position.

FIG. 7 depicts the range of motion through which the device 50 accomplishes its strengthening effect. By moving the hand in the "A" motion, the exercise effect becomes realized. The device is sized and adapted to allow the hand to be fully extended while remaining securely fastened to the arm by means of the forearm retention strap 52. In a preferred embodiment, the shell 56 and elastic members 58*a–e* are designed to be received upon the anterior surface of the forearm. In order to secure the shell 56 and elastic member 58*a–e* upon the surface of the forearm, the forearm retention strap 52 is placed around the forearm and, accordingly, attaches the assembly 40 thereto. The forearm restraint strap 52 is sized and adapted to form a snug, annular fit about the forearm as well as secure the finger tensioning assembly 54 in unvarying position. Preferably, the forearm retention strap 52 has a plurality of T-lock slots 64 on the exterior surface of the strap for firmly interconnecting with T-lock members 88*a–b*, depicted in FIG. 14, formed on the shell 56 (FIG. 7) of the finger tensioning assembly. In addition, the forearm retention strap 52 preferably has strap carriers 62a,b through which the strap may be adjusted to form a snug, secure fit about the forearm when worn by the user.

Figure 8:
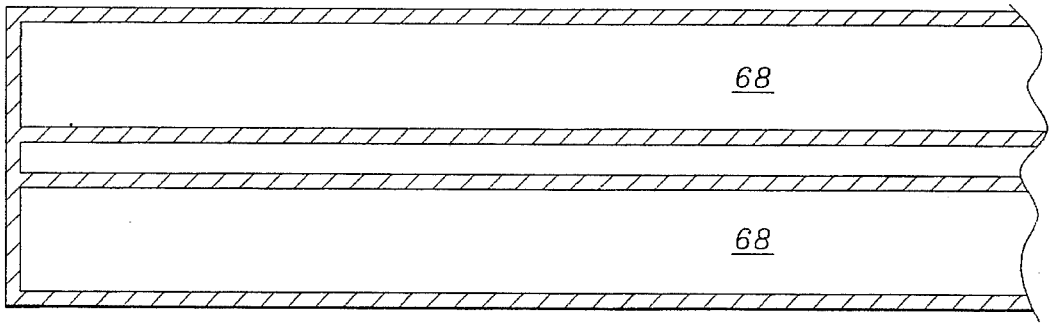
FIG. 8 is a frontal view of an exterior portion of the forearm retention strap.

Referring to FIG. 8, a portion of the exterior surface 68 of the forearm retention strap 52 is illustrated. The interior surface (not shown) is preferably smooth and lightweight so as to form a comfortable yet secure fit about the forearm when worn by a user. Alternatively, the interior surface may have tactile features to maintain the finger tensioning assembly 54 in position, via frictional engagement, while worn about the forearm of the user.

Figure 9:
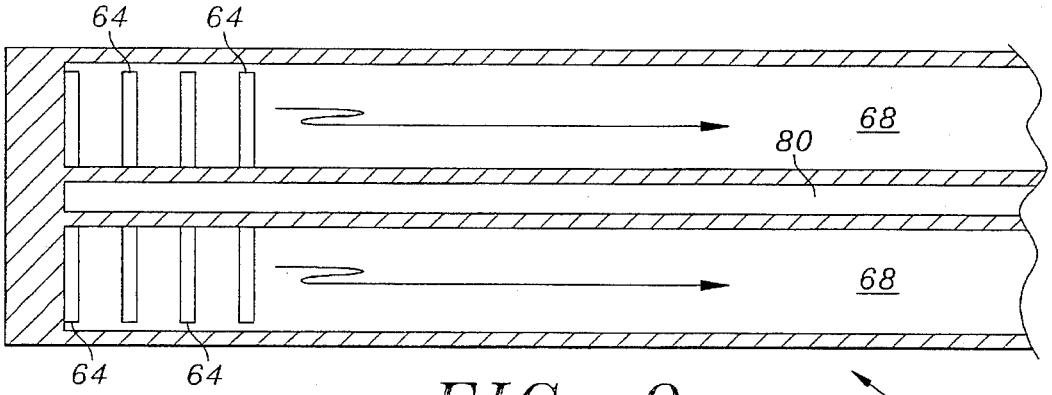
FIG. 9 is a frontal view of an exterior portion of the forearm retention strap.
Figure 14:
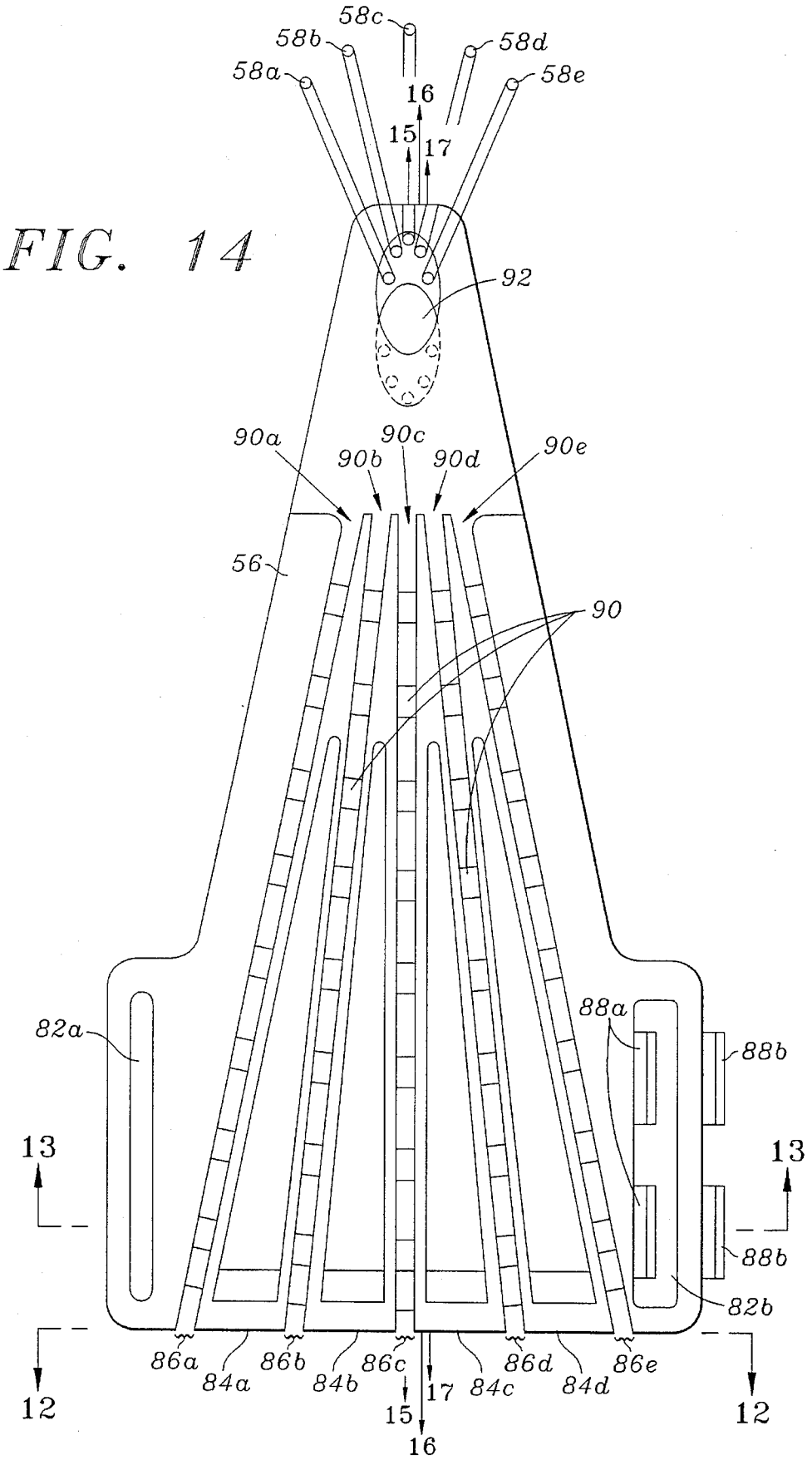
FIG. 14 is a bottom view of the shell of the finger tensioning assembly.

FIG. 9 also depicts a portion of the exterior surface 68 of the forearm retention strap 52. In a preferred embodiment, the exterior surface 68 has two series of T-lock slots 64. The T-lock slots 64 are arranged in pairs that extend outwardly in opposite directions from a median strip 80 extending longitudinally about the exterior surface 68 of the forearm retention strap 52. As more clearly depicted in the T-lock slots 64, when fastened to the T-lock members 88*a–b*, as more clearly depicted in FIG. 14, provide means for adjusting the tension of the forearm retention strap 52 when worn about the forearm as well as provide means for stably securing the finger tensioning assembly 54, as shown in FIG. 7, onto the exterior portion of the forearm when worn by the wearer. Advantageously, the forearm retention strap 52 provides means for allowing the user to use the device while not requiring the user to keep his or her elbow in a locked position.

Referring to FIG. 14, the bottom view of shell 56 of the finger tensioning assembly 54 is shown. In a preferred embodiment, the shell 56 is generally triangular in shape. At the base of the triangular shell are two apertures 82*a,b* for receiving the forearm retention strap 52. Each respective aperture 82*a,b* is positioned on either side of the triangular base. Formed about aperture 82*b* are two series of T-lock members 88*a–b* that are shaped and designed to engage with the T-lock slots 64 on the forearm retention strap 52 so as to firmly attach the finger tensioning assembly 54 to the forearm.

Disposed within the shell 56 are a series of rows of cleat-lock slots 90*a–e*. The cleat-lock slots 90 are designed to detachably fasten the elastic members 58*a–e*. Disposed upon the rows of cleat-lock slots 90*a–e* are a series of guide members 84*a–d*. The guide members 84*a–d*, which are preferably wedge-shaped, define housing channels 86*a–e* wherein each respective elastic member 58*a–e* passes therethrough. Disposed within the top proximal portion of the triangular-shaped shell 56 is an aperture 92. The aperture 92 is designed to allow the elastic members 58*a–e* to extend outwardly from the shell 56 so that the elastic members 58*a–e* may be accessed by the fingers and thumb of the hand.

Figure 10:
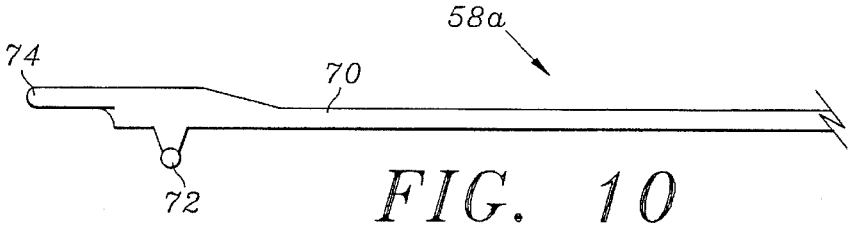
FIG. 10 is a side view of the distal end of an elastic member.
Figure 11:
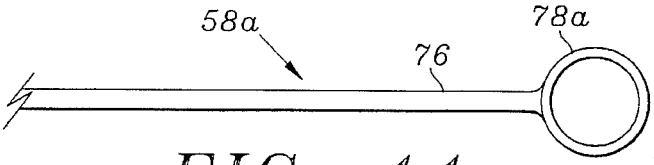
FIG. 11 is a top view of the proximal end portion of an elastic member.

Referring to FIGS. 10 and 11, an elastic member 58*a* is shown. FIG. 10 depicts the distal end 70 of the elastic member 58*a*, wherein the end portion comprises a protuberance 72 and tab 74. The protuberance 72 provides means for detachably fastening with the cleat-lock slot 90 of the shell 56, as is shown in FIG. 14. Once the protuberance 72 is engaged with the cleat-lock slot 90, the elastic member is thus positioned to be received within a housing channel 86 (FIG. 14) as formed by a guide member 84 (FIG. 14). The tab portion 74 of the elastic member 58*a* provides means for manually detaching the elastic member from a cleat-lock slot 90 (FIG. 14). By adjusting the slot into which the protuberance 72 is engaged, the tension of the elastic member may thus be adjusted.

The proximal end of the elastic member 58*a*, as depicted in FIG. 11, is designed to extend outwardly from the shell 56 so as to be readily accessed by a finger or thumb. The proximal end portion 76 has a finger-receiving assembly 78*a* at its terminus. The finger-receiving assembly 78*a* is designed to engage with the end of a finger or thumb, thus providing means through which the muscles of the hand become exercised.

Figure 12:
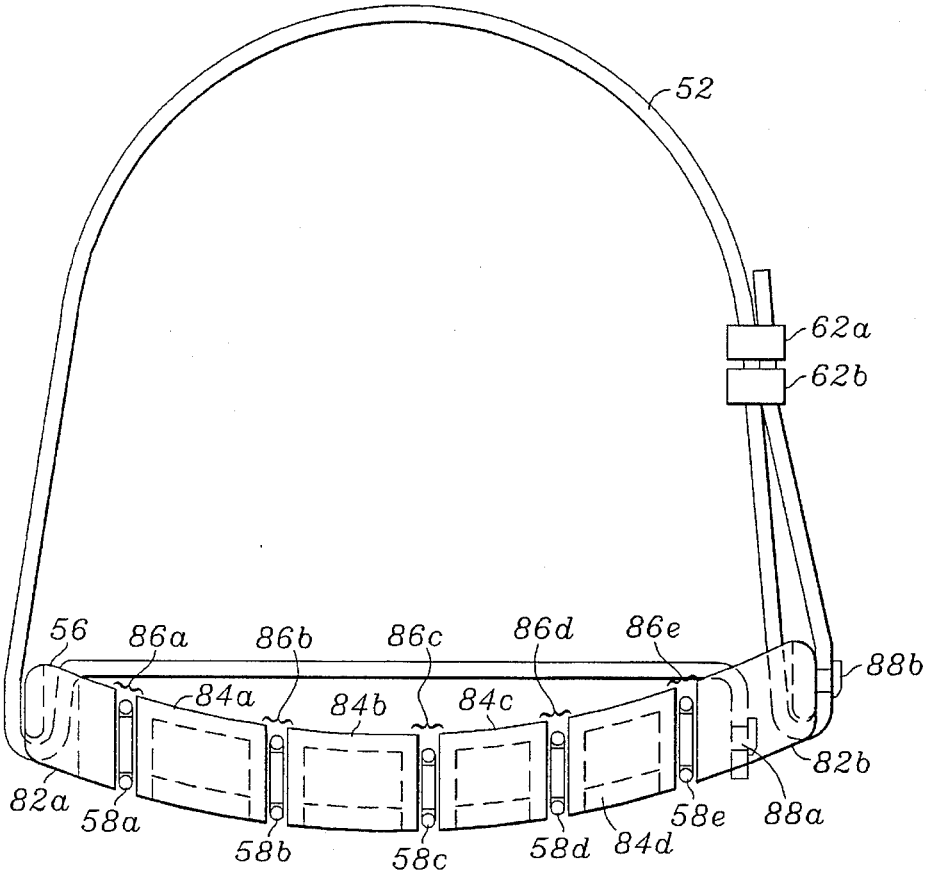
FIG. 12 is a cross-sectional end-view taken along line 12—12 of FIG. 14.

As depicted in FIG. 12, the elastic members 58*a–e* extend around the rear portion 100 of the shell 56 once the protuberances of each elastic member are engaged with a respective one of a row of cleat-lock slots 90*a–e* (FIG. 14). The elastic members 58*a–e* and shell 56 are attached in such a manner that the elastic members loop upwardly toward the anterior surface of the forearm. However, elastic members 58*a–e* do not impinge upon the surface of the arm.

Figure 13:
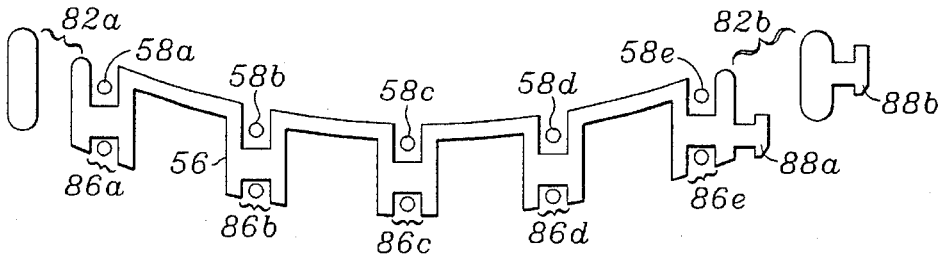
FIG. 13 is a cross-sectional view taken along line 13—13 of FIG. 14.

FIG. 13 further depicts this arrangement between shell 56 and members 58*a–e* as the members are received within housing channels 86*a–e*.

Figure 15:
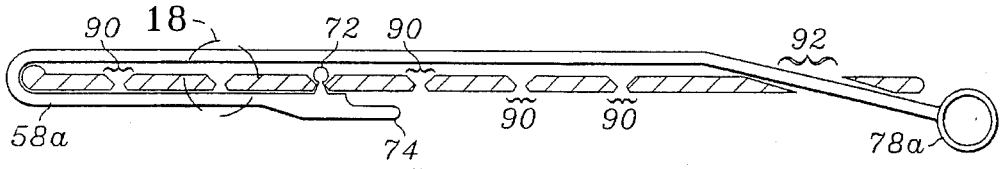
FIG. 15 is a cross-sectional view taken along line 15—15 of FIG. 14.

FIG. 15 is a cross-sectional view taken along line 15—15 of FIG. 14 depicting an elastic member 58*a* being received upon the shell 56 of the finger tensioning assembly 54. The protuberance 72 of the elastic member 58*a* is received within a cleat-lock slot 90 of the shell 56. The tab 74 provides a surface onto which the protuberance may be manually disengaged from the cleat-lock slot 90. The elastic member 58*a* extends around and underneath the series of cleat-lock slots 90 and eventually extends outward from the shell 56. The elastic member 58*a* passes through the shell 56 by means of an aperture 92.

Figure 16:
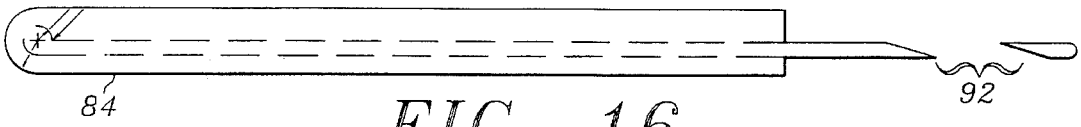
FIG. 16 is a cross-sectional view taken along line 16—16 of FIG. 14.

FIG. 16, which is taken along line 16—16 of FIG. 14, depicts a cross-sectional view of a guide member 84 extending through the length of the shell 56. As mentioned above, the guide member 84 forms a housing channel 86 through which the elastic member 58*a* extends. Accordingly, such guide members 84 provide stability and a smooth contoured pathway through which the elastic member 58*a* may extend.

Figure 17:
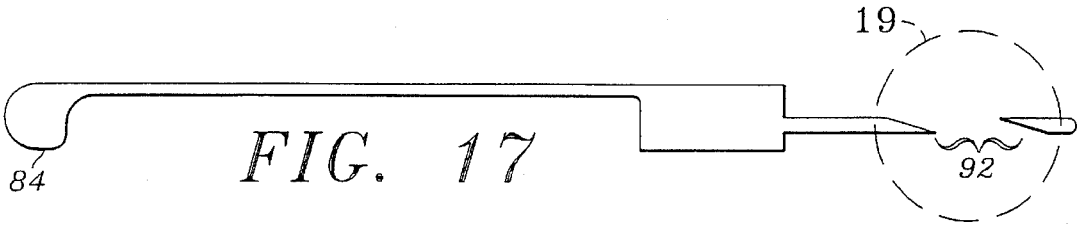
FIG. 17 is a cross-sectional view taken along line 17—17 of FIG. 14.

Referring to FIG. 17, a cross-sectional view is shown of a longitudinally extending portion of the shell as taken through a mid-section of a guide member 84. As depicted, the aperture 92 is shown through which the elastic members 58*a–e* may extend therethrough.

Figure 18:
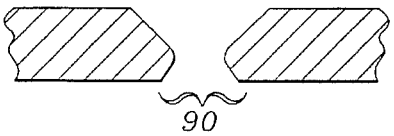
FIG. 18 is a cross-sectional view taken along line 18—18 of FIG. 15.

Referring to FIG. 18, a sectional view taken along portion 18—18 of FIG. 15 depicts a cleat-lock slot 90. The cleat-lock slot 90 is designed to engage with a protuberance 72 of an elastic member 58*a–e*. The cleat-lock slots 90 are spaced at intervals extending longitudinally within the housing channels 86*a–e* of the shell 56. By engaging a protuberance 72 with a cleat-lock slot 90, a given tension is produced that may be adjusted accordingly so as to produce a desired exercise effect.

Figure 19:
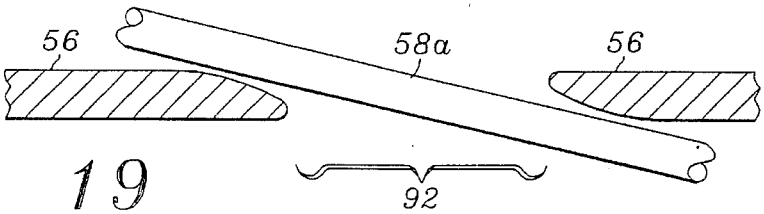
FIG. 19 is a cross-sectional view taken along line 19—19 of FIG. 15.

FIG. 19 depicts the aperture 92 through which an elastic member 58*a* may outwardly extend from the shell 56 toward the fingers of a hand. The elastic member 58*a* extends radially from the shell to the palm of the hand where the member 58*a* can thus be accessed.

Having thus described the structure of the second embodiment of the carpal tunnel exerciser of the present invention, it may be beneficial to describe the use thereof. In order to use the invention, the forearm retention strap 52 (FIG. 6) is received within the apertures 82*a* and 82*b* (FIG. 14) with the T-lock slots 64 (FIG. 64) being engaged with T-lock members 88*a,b* (FIG. 14) provided in the finger tensioning assembly 54*a–e*. Once the forearm retention strap 52 (FIG. 6) and finger tensioning assembly 54*a–e* have been interconnected, the apparatus is placed upon the forearm such that the finger tensioning assembly 54 is received upon the external surface of the forearm. The strap 52 may be adjusted, via the T-lock slots 64, so as to form a snug, comfortable fit. The elastic members are positioned within housing channels 86*a–e* (FIG. 13) as formed by guide members 84*a–d* (FIG. 13). As mentioned above, the protu-berance 72 (FIG. 15) on each elastic member 58*a–e* (FIG. 6) may be received within a given cleat-lock slot 90 (FIG. 15) so that a desired tension may be produced. Once fastened to the shell 56 (FIG. 6), the elastic members 58*a–e* (FIG. 6) become received within the channels 86*a–e* (FIG. 13) formed on the shell 56 and thus extend about the shell 56 as the shell 56 is received upon the anterior surface of the forearm. Each respective digit of the hand is received in a finger-receiving assembly 60*a–e* (FIG. 6) provided by the proximal end 76 (FIG. 11) of an elastic member 58*a–e* (FIG. 11). While in this configuration, the elastic members 58*a–e* (FIG. 11) are able to stretch freely along the channels 86*a–e* (FIG. 13), while the hand is extended, in such a manner that causes the hand to experience the desired exercise effect.

Figure 20:
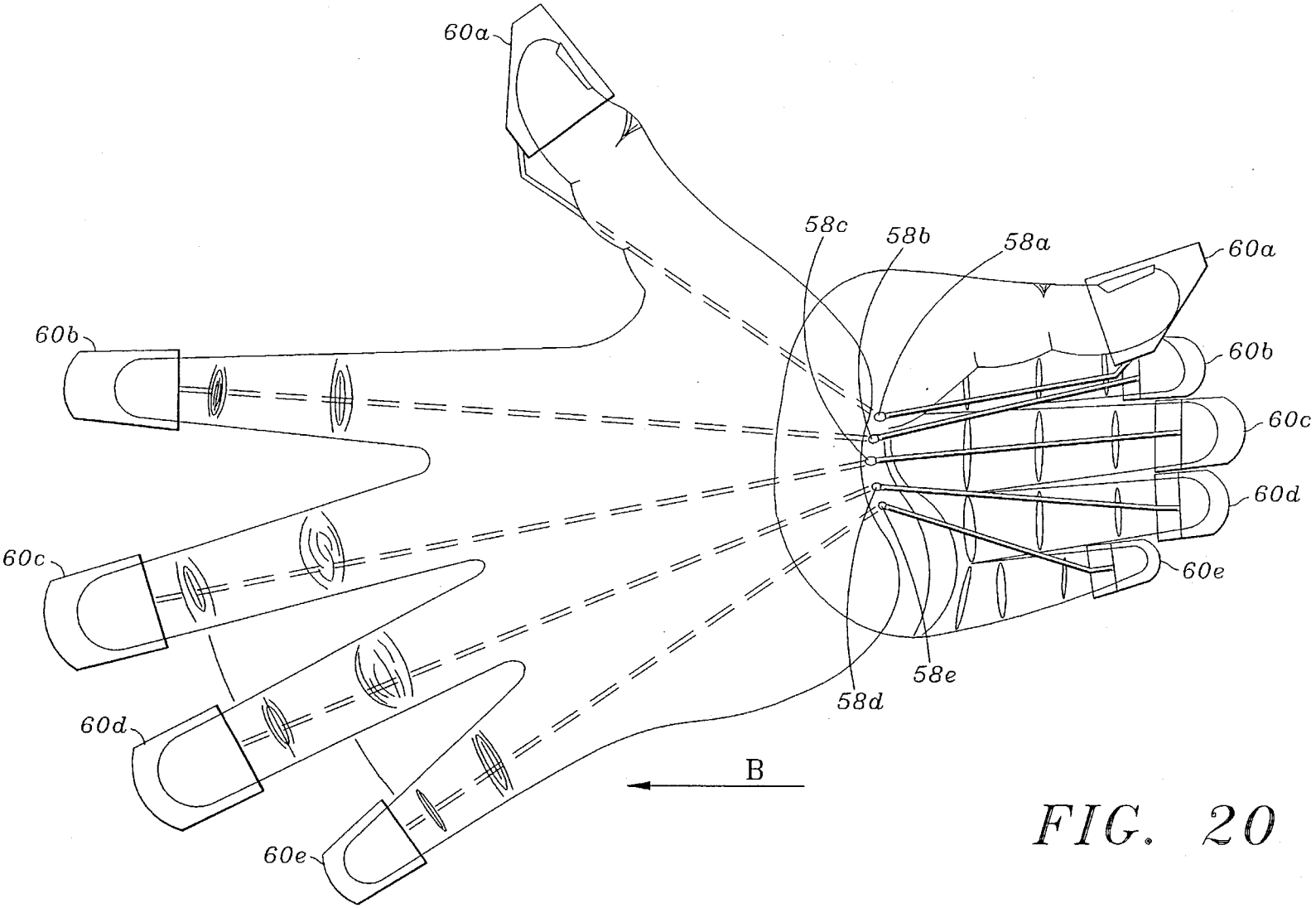
FIG. 20 is a perspective view of a hand having five digits, each digit being received within the finger exerciser, wherein the hand and digits are shown in a first flexed position and a second extended position.

FIG. 20 depicts the range of motion over which the hand is exercised. The extensor muscles of the wrist, hand, and fingers are forced to move in the "B" direction against the tension provided by each elastic member 58*a–e*. Accordingly, by extending the hand away from the finger tensioning assembly 54 in the "B" direction, these extensor muscles become challenged and strengthened. However, this exercise effect is limited only to the extensor muscles as the flexor muscles are not required to resist the tension created by the elastic members 58*a–e*. The exerciser thus selectively strengthens the extensor muscles which, advantageously, counteract the debilitating motions encountered in the development of carpal tunnel syndrome. The effect produced is thus a strengthening of the muscles that are otherwise damaged as the course of the injury progresses.

Furthermore, the exercise device according to the second embodiment provides means for counteracting carpal tunnel syndrome in such a way that does not require the user to maintain his or her elbow in a fixed position while utilizing the exercise device. Similarly, the device is extremely lightweight in nature as well as highly adapted to the anatomy of the wearer such that use of the exerciser will not interfere with the use of arm or other hand.

Thus, the apparatus of the present invention, with various preferred embodiments thereof, have been described in detail with the various advantages being set forth. It is understood, however, that equivalents are possible, and that variations in structure may be made that fall within the underlying principles of the present invention.

What is claimed is:

1. An apparatus for exercising the extensor muscles of the wrists, hands, and fingers comprising:

a) a generally curved, triangular-shaped shell having at least one aperture extending through a proximal end and a plurality of wedge-shaped guide members extending from the distal end towards the aperture, said guide members defining a plurality of housing channels, said housing channels having a series of cleat-lock slots disposed therein;

b) at least one elastic member being extendable through said aperture and through a designated one of said housing channels, said elastic member having a distal end and a proximal end, said proximal end having a finger-receiving assembly formed thereon, said distal end having a tab and protuberance formed thereon, said protuberance being detachably interconnectable with a respective one of said cleat-lock slots; and c) a forearm retention strap engageable with said shell to secure said shell to the forearm of the user, said forearm retention strap having a plurality of slots for interconnecting with a locking member formed upon said shell.

2. The apparatus of claim 1 wherein said shell is adapted to detachably engage five elastic members, said shell having five housing channels and five apertures, each of said five elastic members being extendable through a dedicated aperture and through a dedicated one of said housing channels.

3. The apparatus of claim 2 wherein said shell is provided with at least one strap-retention aperture for receiving and engaging said forearm retention strap to said shell.

4. The apparatus of claim 3 wherein said shell includes at least one surface adapted to be received upon a portion of the forearm.

* * * * *